United States Patent [19]

Johnston, Sr.

[11] Patent Number: 4,648,219

[45] Date of Patent: Mar. 10, 1987

[54] LAWN CRYPT

[75] Inventor: Franklin R. Johnston, Sr., Waxahachie, Tex.

[73] Assignee: Memorial Management and Marketing Concepts, Inc., Waxahachie, Tex.

[21] Appl. No.: 610,797

[22] Filed: May 16, 1984

[51] Int. Cl.[4] ..... E04H 13/00

[52] U.S. Cl. ..... 52/131; 52/125.2; 52/136; 52/234

[58] Field of Search ..... 52/128–142, 52/234, 236.3, 236.4, 125.2; 312/257 A, 265

[56] References Cited

U.S. PATENT DOCUMENTS

| | | | |
|---|---|---|---|
| 642,504 | 1/1900 | Sykes | 52/140 |
| 952,985 | 3/1910 | Ernsberger | 52/136 |
| 998,908 | 7/1911 | King et al. | 52/130 |
| 1,030,385 | 6/1912 | Clarkson | 52/137 |
| 1,167,888 | 1/1916 | Clock | 52/136 |
| 1,422,726 | 7/1922 | Mahar et al. | 52/142 |
| 1,860,266 | 5/1932 | Potts et al. | 52/142 |
| 2,913,895 | 11/1959 | Blasius et al. | 52/137 |
| 3,230,674 | 1/1966 | Christensen | 52/127.1 |
| 3,295,271 | 1/1967 | Dorris | 52/124 |
| 3,455,072 | 7/1969 | Ferris, Jr. | 52/134 |
| 3,564,796 | 2/1971 | Smith | 52/131 |
| 3,570,418 | 3/1971 | Gooding | 312/265 |
| 3,596,419 | 8/1971 | Jalbert | 52/137 |
| 3,642,339 | 2/1972 | Ruderfer | 52/134 |
| 3,719,016 | 3/1973 | Randolph | 52/236.3 |
| 3,772,826 | 11/1973 | Ferver | 52/137 |
| 3,878,656 | 5/1975 | Duwe et al. | 52/134 |
| 3,897,663 | 8/1975 | Gaul | 52/136 |
| 3,968,601 | 7/1976 | Brown et al. | 52/21 |
| 4,021,979 | 5/1977 | Rez | 52/127 |
| 4,099,353 | 6/1978 | Blunt | 52/139 |
| 4,421,366 | 12/1983 | Niziol | 312/257 A |

FOREIGN PATENT DOCUMENTS

| | | | |
|---|---|---|---|
| 808070 | 4/1951 | Fed. Rep. of Germany | 52/234 |
| 1453984 | 9/1966 | France | 52/90 |
| 2368591 | 6/1978 | France | 52/136 |

*Primary Examiner*—John E. Murtagh
*Assistant Examiner*—Andrew Joseph Rudy
*Attorney, Agent, or Firm*—Richards, Harris, Medlock & Andrews

[57] ABSTRACT

A lawn crypt (10) comprises a rectangular array of chambers (22). Each chamber (22) is defined by opposing side panels (34, 46) and opposing end panels (52, 64). A top panel (70) serves to close the chamber and is supported by the side panels (34, 46) and the end panels (52, 64). Each chamber (22) is divided into an upper vault (102) and a lower vault (104) by a horizontal divider (100). The side, end and top panels are fabricated of reinforced concrete such that the crypt (10) can carry the substantial burden of heavy mechanized equipment. By using heavy equipment the operations of opening and closing grave sites can be done with a minimal amount of labor and time.

15 Claims, 6 Drawing Figures

LAWN CRYPT

TECHNICAL FIELD

The present invention pertains in general to a below ground burial structure and in particular to such a structure fabricated of precast panels and designed to carry a substantial weight burden.

BACKGROUND ART

Cemetery space is becoming very limited. Many of the cemeteries that were established years ago have reached or will shortly be reaching their maximum capacity. In most cases it is extremely difficult to expand existing cemeteries since the adjoining land has either been dedicated to other uses or the cost of the land makes such use for cemetery purposes unreasonable. Further, governmental entities have imposed stringent requirements before a new cemetery can be opened. The demand for cemetery space remains substantial but the amount of available space is decreasing drastically.

The business of cemetery operation is traditionally been heavily labor oriented, particularly with the opening and closing of the grave sites. However, with increasing labor costs there is an increasing demand for mechanization of such operations by using relatively heavy equipment to reduce the time and manpower required in cemetery operations. However, the conventional cemetery sites with underground crypts and burial vaults have not been designed to carry the weight of heavy mechanized equipment. Where such structures are currently used the labor and operations must be carried out by light equipment or by entirely manual operations. This can substantially increase the overhead cost for a cemetery operation.

In view of the above limitations of decreasing available land and increasing labor costs, there exists a need for a lawn crypt structure which can provide a relatively high density of burial plots while permitting the use of heavy mechanized equipment to reduce labor requirements as well as the time required to open and close grave sites.

SUMMARY OF THE INVENTION

A selected embodiment of the present invention comprises a lawn crypt for use in a cemetery. The crypt includes a reinforced concrete slab which is located below ground level. A drainage system is provided for draining water from the vicinity of the slab. The crypt comprises an array of contiguous chambers which are formed by a plurality of load-bearing side panels supported on the slab, a plurality of load-bearing end panels supported on the slab and a plurality of load-bearing top panels supported on the corresponding side and end panels for each chamber. Each of the chambers is defined by two opposing and upstanding ones of the side panels, two opposing and upstanding ones of the end panels and one of the top panels which is supported by the two opposing side panels and two opposing end panels. Each of the end panels is joined to at least two of the side panels along respective edges of the end panel. Adjacent ones of the chambers share either one of the side panels or one of the end panels.

In a further aspect of the present invention there is provided a horizontal divider structure within each of the chambers to divide each chamber into an upper vault and a lower vault.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

The present invention comprises a lawn crypt structure which provides a high density of burial plots for a given area of land while permitting the use of heavy equipment to open and close the grave sites thereby reducing the labor requirements and subsequent overhead for the operation of the cemetery.

Figure 1:
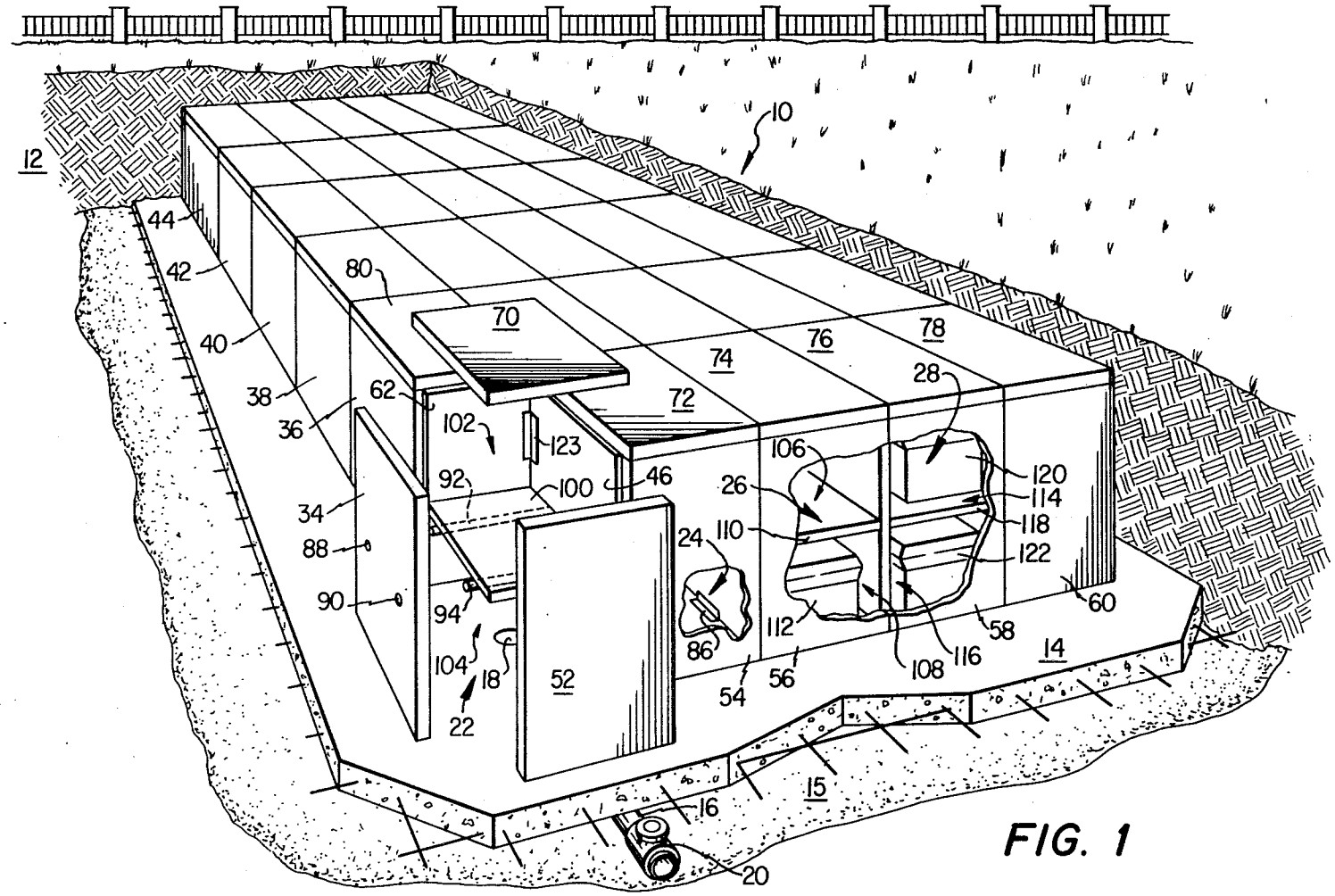
FIG. 1 is a perspective view of the lawn crypt of the present invention within the setting of a cemetery site.

Referring now to FIG. 1 there is illustrated a perspective view of a lawn crypt 10 in accordance with the present invention. The crypt 10 is located below ground level and is covered with an earth fill 12 which is typically on the order of 18 inches thick. In a typical application the crypt 10 is located below the unaltered ground level of a given location. However, in certain applications it may be preferable to alter the grade by raising the ground level at a selected site such that the crypt is partially, or even fully, above the unaltered ground level. This may be required in locations in which there are drainage problems or a high water table.

The crypt 10 includes a reinforced concrete slab 14 which is positioned below the immediate ground level. Below the slab 14 there is provided a drainage system. This system can take the form of a sand base 15 or a system of pipes or a combination of the two can be used. One such drainage system is shown as pipe 16 which is connected to one of a plurality of openings 18 in the slab 14. The pipe 16 can optionally be fitted with a check valve 20 to prevent the reverse flow of water from a drainage site. The pipe 16 is inclined at an angle to drain water away from the vicinity of the slab 14.

The crypt 10 comprises an array of chambers, such as 22, 24, 26 and 28. The chambers are formed by a combination of side panels, such as 34, 36, 38, 40, 42, 44 and 46. The side panels are arranged in parallel rows and within each row the side panels have a common longitudinal axis.

The crypt 10 further includes a plurality of end panels, such as 52, 54, 56, 58, 60 and 62. The end panels are positioned with vertical longitudinal axes and each panel is transverse to the rows of side panels. Each of the end panels is positioned between respective edges of the side panels.

The crypt 10 further includes a plurality of top panels such as 70, 72, 74, 76, 78 and 80.

Figure 2:
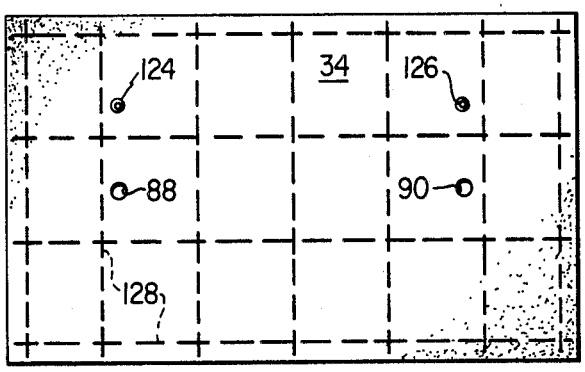
FIG. 2 is a plan view of a side panel for use in accordance with the present invention.
Figure 3:
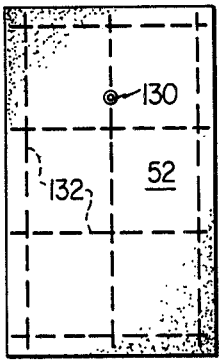
FIG. 3 is a plan view of an end panel for use in accordance with the present invention.
Figure 4:
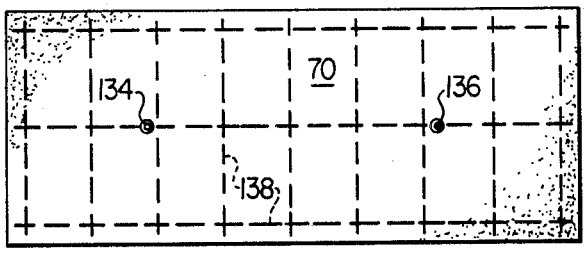
FIG. 4 is a plan view of a top panel for use in accordance with the present invention.

The side panels, end panels and top panels are described in further detail in FIGS. 2, 3 and 4.

Selected ones of the side panels, such as every fourth side panel, is fastened to the slab 14 by means of a steel angle connector. Such a connector 86 is shown joining a side panel within chamber 24 to the slab 14.

Each of the side panels, such as 34, is provided with two holes 88 and 90 which are positioned essentially along the longitudinal centerline for each of the side panels. There are similar holes in the side panel 46. Horizontal rods 92 and 94 are inserted respectively into the holes 88 and 90 and corresponding holes in panel 46. Thus the rods 92 and 94 are supported by the panel 34 and 46.

A horizontal divider 100 is supported on the rods 92 and 94. The divider 100 extends substantially between the side panels 34 and 46 and the end panels 52 and 62.

The panels 34, 52 and 70 for chamber 22 are shown in an exploded view but are positioned permanently in the same fashion as similar panels for the remainder of the chambers within the crypt 10.

The divider 100 serves to divide the chamber 22 into an upper vault 102 and a lower vault 104.

Chamber 26 is divided into an upper vault 106 and a lower vault 108 by a divider 110. The upper vault 106 is empty but the lower vault 108 has received a casket 112. The chamber 28 is divided into an upper vault 114 and a lower vault 116 by a divider 118. The vaults 114 and 116 have received respective caskets 120 and 122.

The side and end panels are joined together by angle connectors such as connector 123 which joins end panel 62 to side panel 46.

Referring now to FIG. 2 there is illustrated in detail the side panel 34 which is representative of all of the side panels within the crypt 10. The holes 88 and 90 are positioned essentially along the longitudinal center line of the panel 34. They are preferably 2 inches in diameter and are evenly spaced with each located approximately 18 inches from the end of the panel 34.

The panel 34 is further provided with lifting inserts 124 and 126. These inserts are cast into the panel 34.

The panel 34 further includes a reinforcement bar structure 128. The panel 34 preferably uses number 3 rebar in both the transverse and longitudinal directions.

The preferred dimensions for the panel 34 are seven feet six inches long, four feet six inches wide and three inches thick. The preferable rebar spacing for structure 128 is one foot four inches between longitudinal bars and one foot three inches between transverse bars with a one foot spacing for the extreme right and left rebar elements.

The lifting inserts 124 and 126 are preferably a model CX-28 manufactured by Meadow Steel Products, Inc. These inserts are shown in detail in FIG. 6.

The end panel 52 is illustrated in detail in FIG. 3. Panel 52 is similar to the other end panels used within the crypt 10. The panel 52 includes a lifting insert 130 which is located along the central line of the panel 52 and offset from the center of the panel. The panel 52 further includes a rebar structure 132 which comprises number 3 rebar in both the longitudinal and transverse directions. The rebar structure 132 has a preferable spacing of one foot 1½ inches in the transverse direction and a spacing of one foot four inches in the longitudinal direction.

The preferred dimensions for the panel 52 are a length of four feet six inches, a width of two feet nine inches and a thickness of three inches.

The top panel 70 is shown in a detail illustration in FIG. 4. This top panel is similar to the remainder of the top panels within the crypt 10. The panel 10 includes lifting inserts 134 and 136 which are preferably a model number CX-24 also manufactured by Meadow Steel Products, Inc. The model CX-24 is slightly larger than the model CX-28 shown in FIG. 6. The lifting inserts 134 and 136 are positioned along the center line of the panel 70 with each insert approximately one foot 10½ inches from the end of the panel.

The panel 70 further includes a rebar structure 138 which preferably has number 4 rebar in the longitudinal direction and number 6 rebar in the transverse direction. The longitudinal spacing is preferably 10½ inches and the transverse spacing is preferably one foot three inches.

The preferred dimensions for the top panel 70 are a length of seven feet six inches, a width of three feet and a thickness of four inches.

The panels 34, 52 and 70 are preferably fabricated of a concrete which has a minimum compressive strength of 3,000 pounds per square inch.

Figure 5:
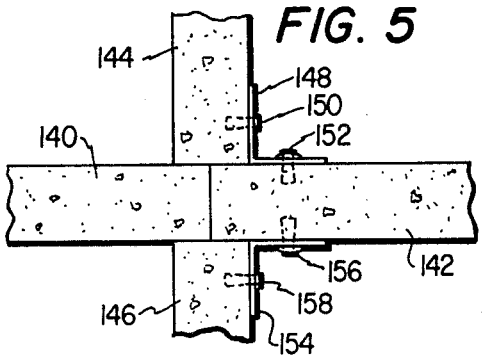
FIG. 5 is a detail view showing the joining of the side and end panels for fabrication of the crypt of the present invention.

A detailed construction view for the interconnecting of the side and end panels is shown in FIG. 5. Side panels 140 and 142 are butted together. End panels 144 and 146 have vertical edges thereof positioned against the junction of side panels 140 and 142. The end panels 144 and 146 are positioned flush with the surfaces of the side panels 140 and 142.

An angle connector 148 is secured to end panel 144 by a plurality of concrete nails, such as 150. The connector 148 is further secured to side panel 142 by a concrete nail 152. An angle connector 154 joins end panel 146 to side panel 142. A concrete nail 156 secures connector 154 to panel 142. A concrete nail 158 secures connector 154 to end panel 146.

In a typical application there are two angle connectors for joining panels for each chamber. Each of the corner chambers, such as 22, has all four corners fastened by the angle connectors.

Figure 6:
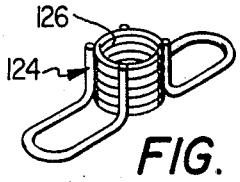
FIG. 6 is a perspective view of a lifting insert which is cast into the panels shown in FIGS. 2, 3 and 4.

Referring now to FIG. 6 there is illustrated the lifting insert 124 shown in FIG. 2. The insert 124 is preferably a model CX-28 as noted above. The insert 124 has an internal thread 160 for receiving a bolt, such as an eye bolt which can then be used as a connector for lifting a panel.

In a typical application of the crypt 10 there is provided an 18" earth fill above the top panels. With the dimensions described above for the panels of the crypt 10, each of the chambers has the capacity to support a weight of at least 16,000 pounds. This is the maximum weight that a typical piece of heavy equipment would apply to the top of the crypt 10 at a given point. This weight burden is carried by a top panel, such as 80 and is transmitted through the load-bearing side panels 34 and 46 and the load-bearing end panels 52 and 64. The weight is ultimately carried by the slab 14 which is typically four inches thick.

In a typical application of a lawn crypt 10, a site is excavated so that the resulting ground level will have an earth fill of at least 18" above the top of the crypt 10. After the excavation the reinforced concrete slab 14 is installed together with appropriate drainage. The side panels, such as 34 and the end panels, such as 52, are then installed to form a rectangular array to define the numerous chambers. Finally the top panels, such as 70 are installed over each chamber to complete the enclosure of the chambers. Next the earth fill is returned to completely bury the crypt 10.

As each grave site is required, a unit of heavy equipment, such as a front end loader, removes the earth fill above the required chamber. Eye hooks are then inserted into the lifting inserts, such as 134 and 136, for a top panel. The front end loader then lifts the top panel, such as 70 to open the chamber 22. A casket is then received into the lower vault 104 of the chamber 22. Next the horizontal rods 92 and 94 are inserted into the respective holes in the side panels, such as 34 and 46. The horizontal divider 100 is then lowered into the chamber 22 to divide it into the upper vault 102 and the lower vault 104. The top panel 70 is then replaced and the earth fill returned to its original location. By the use of heavy mechanized equipment, such as a front end loader, it is possible for one worker to open and close the grave site in a minimal amount of time. When the upper vault 102 is required, the earth fill and the top panel 70 are removed.

The present invention provides a substantial increase in the available number of plots for cemeteries. In the conventional layout of a cemetery arrangement there are approximately 1250 burial locations per acre. Through use the present invention there are provided approximately 3,700 burial locations per acre. Thus, the utilization of valuable land is substantially increased.

In a lawn crypt array which is x end panels wide and y side panels long, there are (x) times (y) number of chambers and the same number of top panels, (x+1) times (y) number of side panels and (y+1) times (x) number of end panels.

In summary the present invention comprises a lawn crypt structure which substantially increases the density of grave sites for cemetery land and makes possible the use of heavy equipment to reduce the labor required for cemetery operations.

Although one embodiment of the invention has been illustrated in the accompanying drawings and described in the foregoing detailed description, it will be understood that the invention is not limited to the embodiment disclosed, but is capable of numerous rearrangements, modifications and substitutions without departing from the scope of the invention.

I claim:

1. An underground burial crypt constructed to support heavy mechanized equipment performing cemetery operations at ground level, comprising:

a reinforced concrete slab located below ground level, means for draining water from the vicinity of said slab, an array of contiguous chambers formed by:

(i) a plurality of load bearing side panels supported on said slab, (ii) a plurality of load bearing end panels supported on said slab, (iii) a plurality of load bearing top panels, each of said panels being formed individually of reinforced concrete, and each of said chambers defined by two opposing and upstanding ones of said side panels, two opposing and upstanding ones of said end panels and one of said top panels supported by said two opposing side panels and said two opposing end panels, each said end panel joined to at least two of said side panels along respective edges of said end panel, wherein adjacent ones of said chambers share either one of said side panels or one of said end panels, each of said chambers capable of supporting the weight of at least 16,000 lbs., the top panels of adjacent ones of said chambers sharing a side panel, each top panel resting on a portion of a top edge of the side panel so that the side panel directly supports both top panels, the top panels of adjacent ones of said chambers sharing a common end panel also each being supported on a portion of a top edge of the end panel so that the end panel directly supports both top panels.

2. A crypt as recited in claim 1 wherein said side panels, said end panels and said top panels comprise rectangular, precast, reinforced concrete members.

3. A crypt as recited in claim 1 including a horizontal divider means mounted to the opposing side walls for each of said chambers for forming an upper vault and a lower vault in said chamber.

4. A crypt as recited in claim 2 wherein said horizontal divider means comprises a pair of horizontally mounted rods extending into holes in said side panels, said holes spaced apart and located essentially in the centerline of said side panels, said horizontal divider means further including a rectangular panel supported on said rods and extending substantially between said side panels and said end panels.

5. A crypt as recited in claim 1 further including means for securing selected ones of said side panels to said slab.

6. A crypt as recited in claim 1 wherein the width of said top panel, is essentially equal to the width of said end panels plus the thickness of said side panels.

7. A crypt as recited in claim 1 wherein the vertical edges of adjacent, colinear ones of said side panels are butted together at a junction and the vertical edges of contiguous end panels at said junction are flush with the surfaces of said side panels and offset by the thickness of said side panels.

8. A crypt as recited in claim 1 wherein each of said top panels, each of which is supported by two of said side panels and two of said end panels, can carry a load of at least 16,000 pounds.

9. A crypt as recited in claim 1 wherein said crypt is a rectangular array of said chambers, said array x number of said end panels wide and y number of said side panels long wherein said array contains x times y number of said chambers, x times y number of said top panels, (x+1) times y number of said side panels and (y+1) times x number of said end panels.

10. A crypt as recited in claim 1 wherein said means for draining water comprises at least one pipe located beneath said slab and tilted to drain water therein away from said slab, said slab having a plurality of holes therein connected to said pipe wherein water collected on the surface of said slab drains through said holes and out said pipe.

11. A crypt as recited in claim 9 further including a check valve in said pipe to prevent water from backing up through said pipe onto said slab.

12. An assembly for fabricating an underground burial crypt to support heavy mechanized equipment performing cemetary operations at ground level, comprising:

a reinforced concrete slab for providing a load bearing foundation below ground level, a plurality of load bearing side panels each comprising a rectangular reinforced concrete panel having two spaced apart holes therein along the centerline thereof and two spaced apart lifting inserts therein offset from the centerline thereof, a plurality of load bearing end panels each comprising a rectangular reinforced concrete panel having one lifting insert therein, the length of each end panel substantially equal to the width of said side panels, and a plurality of load bearing top panels each comprising a rectangular reinforced concrete panel having two spaced apart lifting inserts therein, the length of said top panels substantially equal to the length of said side panels, wherein a pair of said side panels, a pair of said end panels and one of said top panels form one of a plurality of chambers for said burial crypt.

13. An assembly as recited in claim 11 including means for joining the vertical edges of said side panels and said end panels to form said chamber having a rectangular shape.

14. An assembly as recited in claim 11 including a pair of horizontal rods for insertion into corresponding ones of said holes in said side panels and a horizontal panel for resting on said horizontal rods.

15. An underground burial crypt constructed to support heavy mechanized equipment performing cemetary operations at ground level, comprising:

a reinforced concrete slab located below ground level, means for draining water from the vicinity of said slab, an array of contiguous chambers formed by:

(i) a plurality of rectangular, load bearing, reinforced concrete side panels each having two offset holes therethrough located essentially along the centerline of the side panel, said side panels positioned in parallel rows on said slab wherein the side panels in each row have a common longitudinal axis, selected ones of said side panels joined to said slab, (ii) a plurality of rectangular, load bearing, reinforced concrete end panels, the length of each of said end panels essentially equal to the width of said side panels, said end panels positioned on said slab with a vertical longitudinal axis and transverse to said rows of said side panels, each vertical edge of said end panels located against at least one of said side panels, (iii) a plurality of rectangular, load bearing, reinforced concrete top panels, the length of each of said top panels essentially equal to the length of said side panels, each of said chambers defined by said slab, two opposing ones of said side panels, two opposing ones of said end panels and one of said top panels supported by said two opposing side panels and said two opposing end panels, each said end panel joined to at least two of said side panels along respective vertical edges of said end panel, wherein adjacent ones of said chambers share either one of said side panels or one of said end panels, a plurality of rods mounted in the holes in said opposing side panels, and a divider panel supported on said rods for dividing said chamber into an upper vault and a lower vault.

* * * * *